US012053853B2

(12) United States Patent
Litty et al.

(10) Patent No.: US 12,053,853 B2
(45) Date of Patent: Aug. 6, 2024

(54) METHOD FOR PRODUCING ROTATIONALLY SYMMETRICAL, NON-CYLINDRICAL BORES WITH A HONING TOOL, AND HONING MACHINE WHICH IS DESIGNED AND EQUIPPED FOR MAKING A CYLINDRICAL BORE INTO A CONICAL BORE

(71) Applicant: Gehring Technologies GmbH, Ostfildern (DE)

(72) Inventors: Klaus Litty, Kernen (DE); Andreas Wagner, Denkendorf (DE); Manuel Waiblinger, Stuttgart (DE); Andreas Wiens, Sachsenheim (DE); Niko Schamne, Ostfildern (DE); Markus Petraschek, Ostfildern (DE)

(73) Assignee: Gehring Technologies Gmbh, Ostfildern (DE)

( * ) Notice: Subject to any disclaimer, the term of this patent is extended or adjusted under 35 U.S.C. 154(b) by 1067 days.

(21) Appl. No.: 16/088,521

(22) PCT Filed: Mar. 29, 2017

(86) PCT No.: PCT/EP2017/057458
§ 371 (c)(1),
(2) Date: Sep. 26, 2018

(87) PCT Pub. No.: WO2017/167829
PCT Pub. Date: Oct. 5, 2017

(65) Prior Publication Data

US 2019/0111540 A1 Apr. 18, 2019

(30) Foreign Application Priority Data

Mar. 29, 2016 (DE) ..... 10 2016 105 717.7

(51) Int. Cl.
*B24B 33/02* (2006.01)
*B24B 33/08* (2006.01)
*B24B 49/04* (2006.01)

(52) U.S. Cl.
CPC ..... *B24B 33/025* (2013.01); *B24B 33/087* (2013.01); *B24B 33/088* (2013.01); *B24B 49/04* (2013.01)

(58) Field of Classification Search
CPC ..... B24B 33/02; B24B 33/025; B24B 33/027; B24B 33/06; B24B 33/087; B24B 33/088; B24B 49/02; B24B 49/04
(Continued)

(56) References Cited

U.S. PATENT DOCUMENTS 4,455,789 A * 6/1984 Gehring ..... B23Q 15/0075 451/17
4,504,917 A * 3/1985 Grimm ..... B24B 33/02 700/193
(Continued)

FOREIGN PATENT DOCUMENTS

DE 102011076213 A1 3/2012
DE 1020130204714 A1 10/2014
(Continued)

OTHER PUBLICATIONS

International Search Report and Written Opinion Form PCT/ISA/210 and PCT/ISA/237, International Application No. PCT/EP2017/057458, pp. 1-10, International Filing Date Mar. 29, 2017, mailing date of search report Jun. 14, 2017.
(Continued)

*Primary Examiner* — Brian D Keller
*Assistant Examiner* — Marcel T Dion
(74) *Attorney, Agent, or Firm* — BOND, SCHOENECK & KING, PLLC; George R. McGuire

(57) ABSTRACT

A method for honing a rotationally symmetric, non-cylindrical bore includes the steps of limiting the stroke of a
(Continued)

honing tool between upper and lower reversal points, continoulsy detecting the actual diameter of the bore at all points along its length between the upper and lower reversal points, continuously comparing the actual diameter of the bore to a specified target diameters for at least one of the upper or lower reversal points, continuously limiting the stroke to regions of the bore in which the actual diameter is smaller than the target diameter, continuously limiting the stroke to regions of the bore in which the actual diameter is smaller than the target diameter, and reducing the stroke of the honing tool step-by-step based on the detected actual values of the diameter of the bore, so that it only the regions of the bore that are machined in which the actual diameter of the bore is smaller than the target diameter corresponding to the detected actual values of the diameter.

10 Claims, 9 Drawing Sheets

(58) Field of Classification Search
USPC ..... 451/5, 10, 11, 27, 178, 155, 61
See application file for complete search history.

(56) References Cited

U.S. PATENT DOCUMENTS 4,945,685 A 8/1990 Kajitani et al.
5,193,314 A * 3/1993 Wormley ..... B24B 47/25 451/296
2003/0120374 A1* 6/2003 Klink ..... B24B 33/088 700/182
2005/0130560 A1 6/2005 Klink et al.
2007/0298685 A1* 12/2007 Cloutier ..... B24B 49/16 451/5
2011/0223833 A1* 9/2011 Rauscher ..... B24B 49/12 451/1
2012/0184182 A1* 7/2012 Mayer ..... B23Q 15/04 451/5
2016/0303702 A1 10/2016 Xavier et al.
2017/0129070 A1* 5/2017 Flores ..... B24B 33/083
2017/0304978 A1* 10/2017 Nonaka ..... B23B 41/04

FOREIGN PATENT DOCUMENTS

DE 20150203051 A1 8/2016
DE 1020150209609 A1 12/2016
JP 864078755 3/1989
JP H09047957 2/1997
JP 2007015036 A 1/2007
JP 2008023596 A 2/2008
JP 2016516595 A 6/2016
WO 2014146919 A1 9/2014
WO 20140146919 A1 9/2014
WO 20160131735 A1 8/2016

OTHER PUBLICATIONS

German Office Action 1102016105717.7, pp. 1-5, created on Feb. 15, 2017.
Written Opinion Form PCT/IPEA/408, Application PCT/EP2017/057458, pp. 1-8, International Filing Date Mar. 29, 2017.
International Preliminary Report on Patentability Form PCT/IPEA/416, Application PCT/EP2017/057458, pp. 1-56, dated Aug. 15, 2018.
Japanese Patent Office Communication, pp. 1-6.
Japanese Patent Office Communication, pp. 1-4.

* cited by examiner

METHOD FOR PRODUCING ROTATIONALLY SYMMETRICAL, NON-CYLINDRICAL BORES WITH A HONING TOOL, AND HONING MACHINE WHICH IS DESIGNED AND EQUIPPED FOR MAKING A CYLINDRICAL BORE INTO A CONICAL BORE

CROSS-REFERENCE TO RELATED APPLICATIONS

This application is the U.S. National Stage Application of PCT Application No. PCT/EP2017/057458 filed on Mar. 29, 2017, which relates and claims priority to German patent application No. DE 102016105717.7, filed on Mar. 29, 2016, the entire disclosure of each of which is incorporated herein by reference.

BACKGROUND

The invention relates to a method for conifying a cylindrical bore using a honing tool, as well as a process chain for shape machining cylindrical bores.

The manufacturers of motor vehicles are faced with the long-term task of continually reducing the fuel consumption of their vehicle fleet equipped with reciprocating piston engines. The friction in reciprocating piston engines between the piston or piston rings, on one hand, and the cylinder bore has a large proportion, up to 35%, of the internal friction loss. Reducing friction in the region of the cylinder bore therefore offers a significant potential for reducing fuel consumption.

An approach to reducing friction between pistons and the cylinder bore is the shape honing developed by the applicant, which is described in detail in EP 2 170 556 B1. In this method, deviations from the geometry of the cylinder caused by tensions during mounting and/or thermal expansion of the cylinder bore are equalized in that complementary raised points or recesses are formed during the shape honing. This method is very effective and is successfully used during the manufacturing of different reciprocating piston engines.

A honing method is known from DE 10 2013 204 714 A1, via which the cylinder bore of a combustion engine obtains a bottle shape. A shape described as a bottle form is one, in which the cylinder bore has two sections that have a different diameter. The section having the smaller diameter is provided in the region of the cylinder head while the section having the larger diameter is provided in the region of the crankshaft. A conical transition region is formed between these regions that takes up approximately 5% to 20% of the bore length.

A method is known from U.S. Pat. No. 4,945,685 for honing a cylindrical bore in which during the honing process the diameter of the bore being machined measures at the upper reversal point ZU and at the lower reversal point ZL of the honing spindle and in the middle ZL between these reversal points. Then the diameter DM in the middle between the reversal points is compared to the diameters DU and DL in the reversal points. Depending on the differences DM-DU and DM-DL, the upper reversal point ZU and the lower reversal point ZL of the honing spindle are changed, thereby improving the cylindricity of the bore.

SUMMARY OF THE INVENTION

The invention is based on the object of preparing a honing method that permits the economical and reproducible manufacture of cylinder bores, wherein the friction between the piston rings and especially between the piston skirt and the cylinder bore is minimized and, as a consequence, the emissions behaviour and the fuel consumption of the combustion vehicle equipped with such cylinders is optimized. The invention is also based on the object of providing a honing machine designed and equipped for this.

The method is intended to allow for the use of a wide variety of geometries of the cylinder bore specified by the user in series production in a precise and process stable manner. In this method, the geometries specified by the user, for example a cone, a bottle shape or a contour line that can be defined by a polynomial of the nth order, can be the "cylinder bore" of a combustion vehicle.

This object is achieved according to the invention by a method for conifying a cylindrical bore or parts of a cylindrical bore.

In the method, a honing tool is used that has measuring devices which allow the varying diameters D (y) of the cylinder bore along the length of the cylinder bore to be detected during the machining. Air-measurement nozzles are suitable as measuring devices. In general, honing bars have a length that is shorter than one third of the length of the bore to be machined. The smaller the honing bar length, the shorter the wavelength of the target shape can be, because, as bar length increases, the wavelengths of the target shapes which are smaller than the honing bar length get mechanically filtered out. The measuring devices are generally arranged between the honing bars so that the bore measurement can be detected there, where the material removal takes place.

The method according to the invention has a closed control circuit, as a result, causes the different diameters D across the length of the bore to be machined to be measured during the machining by means of a permanent measuring (=permanent detection) and gradually reduced diameter corresponding to the measured actual values of the diameter of the stroke of the honing tool so that only the regions of the bore are machined in which the actual diameter of the bore is still smaller than the target diameter. In the region or regions of the bore in which the actual diameter of the bore is equal to the target diameter specified there, no further machining of the bore takes place. "Permanent measuring" means that the diameter of the bore is detected during the honing process continuously as well as with a high temporal and spatial resolution. In this manner, the current shape of the bore being machined is already available in real time for regulation of the honing process during the honing process.

Because of the permanent measuring, a continuous comparison takes place between the actual shape and the target shape and a permanent stroke displacement takes place with the smallest variations in travel, so that a continuous, stepless shape is produced. The smallest-possible amounts of stroke dislocation are essentially only specified by the resolution of the position measuring system.

By regulation of the diameter D(y) of the bore, a variety of non-cylindrical contour lines can be produced simply, process stable and with the highest reproducibility. One reason for the high achievable precision is that effects such as wear and tear on the cutting faces of the honing bars or changes in the contact pressure force and the like have have no influence on the result of the honing process according to the invention because the control circuit according to the invention eliminates these influencing variables. The control variable of the control circuit according to the invention is the stroke OP-UP of the honing tool. The stroke of the honing tool is limited by an upper reversal point OP and by a lower reversal point UP.

The method according to the invention comprises the steps explained in more detail in conjunction with FIG. 2 et. seq.

In an additional advantageous embodiment of the invention, it is provided that—based on a stroke $H_n$—the stroke of the honing tool is reduced to a stroke $H_{n+1}$ if the actual diameter of the bore for at least one reversal point $OP_n$, $UP_n$ of the honing tool is equal to the target diameter in one of these reversal points and that the honing bars of the honing tool, after the stroke $H_n$ has been reduced to $H_{n+1}$, the point or the region of the bore in the previous reversal points $OP_n$, $UP_n$ is no longer machined. In this manner, it is ensured that only the region or regions of the bore in which the actual diameter $D_{IST}$ (y) is still smaller than the target diameter $D_{SOLL}$ (y) desired there are machined further.

The reduction of the stroke can be accomplished in different ways. An alternative that can be very easily realized in terms of control technology provides that the stroke $H_n$ is always reduced by a specified amount DeltaH in order to arrive at a reduced stroke $H_{n+1}$. The amount of DeltaH is generally selected as a function of the total length of the bore to be honed. The desired contour line can also have an influence on the amount of DeltaH.

The stroke $H_{n+1}$ is further reduced if at a further reversal point $OP_{n+1}$, $UP_{n+1}$ the actual diameter $D_{Ist(n+1)}$ of the bore section honed last is equal to the target diameter $D_{soll}$ $UP_{n+1}$ of the bore at this reversal point $OP_{n+1}$, $UP_{n+1}$.

Alternatively to this reduction of the stroke by a constant amount, it is also possible that, based on the current actual diameter of the bore or the honing bars, a diameter amount DeltaX is always added to the actual diameter and the cutting point of the contour line of the desired bore is formed having this diameter $D_{Ist}$+DeltaX any time the stroke is to be reduced. The cutting site then forms the new reversal point OP, UP of the honing tool.

This alternative is explained in detail below in conjunction with the figures (see FIG. 4).

At the beginning of the honing process according to the invention, the bore is generally machined along the entire length so that the method according to the invention proceeds from a cylindrical bore.

The desired target shape or contour line of the bore to be machined can be given as a mathematical function, e.g. as a polynomial of the nth order as a function of the Y-axis (longitudinal axis of the bore). Alternatively, it is also possible to specify the diameter in a table of values. The corresponding diameters for different points of the bore along the Y-axis are entered into this table of values. Intermediate values between these reference points can be formed by interpolation (linearly or progressively).

In order to achieve as uniform a honing pattern as possible, it can be advantageous to increase the speed of the honing spindle as the stroke decreases. The cutting characteristics and the abrasive performance for the honing bars then remain unchanged in the first approach. It is also possible to increase the contact pressure with which the honing bars are pressed against the bore instead of the speed in order to achieve an unaltered removal. A combination of the two measures is also possible.

The same advantages are achieved by the use of the honing machine according to the invention.

Additional advantages and advantageous embodiments can be derived from the drawings to follow, their description and the claims. All features identified in the drawings, their description and the claims can be significant for the invention both alone or in any combination.

BRIEF DESCRIPTION OF THE DRAWINGS

Shown are.

DETAILED DESCRIPTION OF THE EXEMPLARY EMBODIMENTS

Figure 1A:
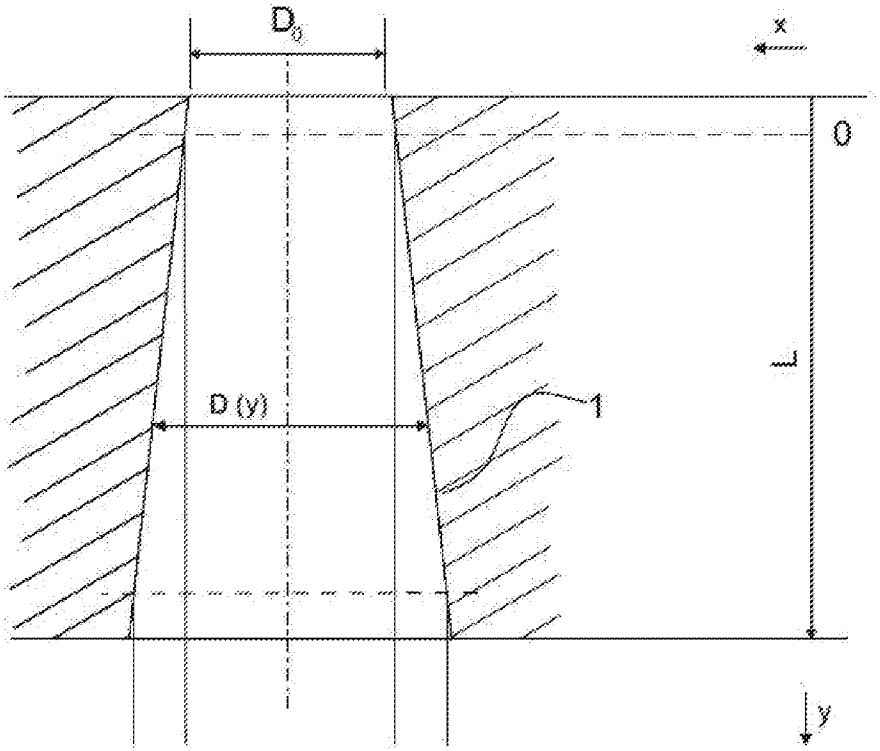
FIGS. 1*a* and 1*b*: Schematic illustration of an originally cylindrical bore that is conified using the method according to the invention.

FIG. 1 is a cylinder bore, shown schematically, having a diameter D (y) that increases in the direction of the longitudinal axis of the bore (Y-axis). On the upper end, bore 1 has a diameter $D_0$. Diameter $D_0$ corresponds to the diameter of the bore after pre-honing if the bore is still cylindrical. After pre-honing, the bore has the diameter $D_0$ along its entire length L.

It is the object of the method according to the invention to produce a bore that is primarily conical. In the example illustrated in FIG. 1, after the implementation of the honing according to the invention, the bore is conical over the entire length L. The contour line of the conically honed bore is indicated using 1 in FIG. 1. It is generally valid for all figures that the same reference characters are used for the same components or methods and only the differences are explained for each.

It has been found, surprisingly, that by using the method according to the invention, conified or other non-cylindrical bores can be produced in the shortest time process stable and with high precision. A variety of contour lines can thus be specified.

Figure 1B:
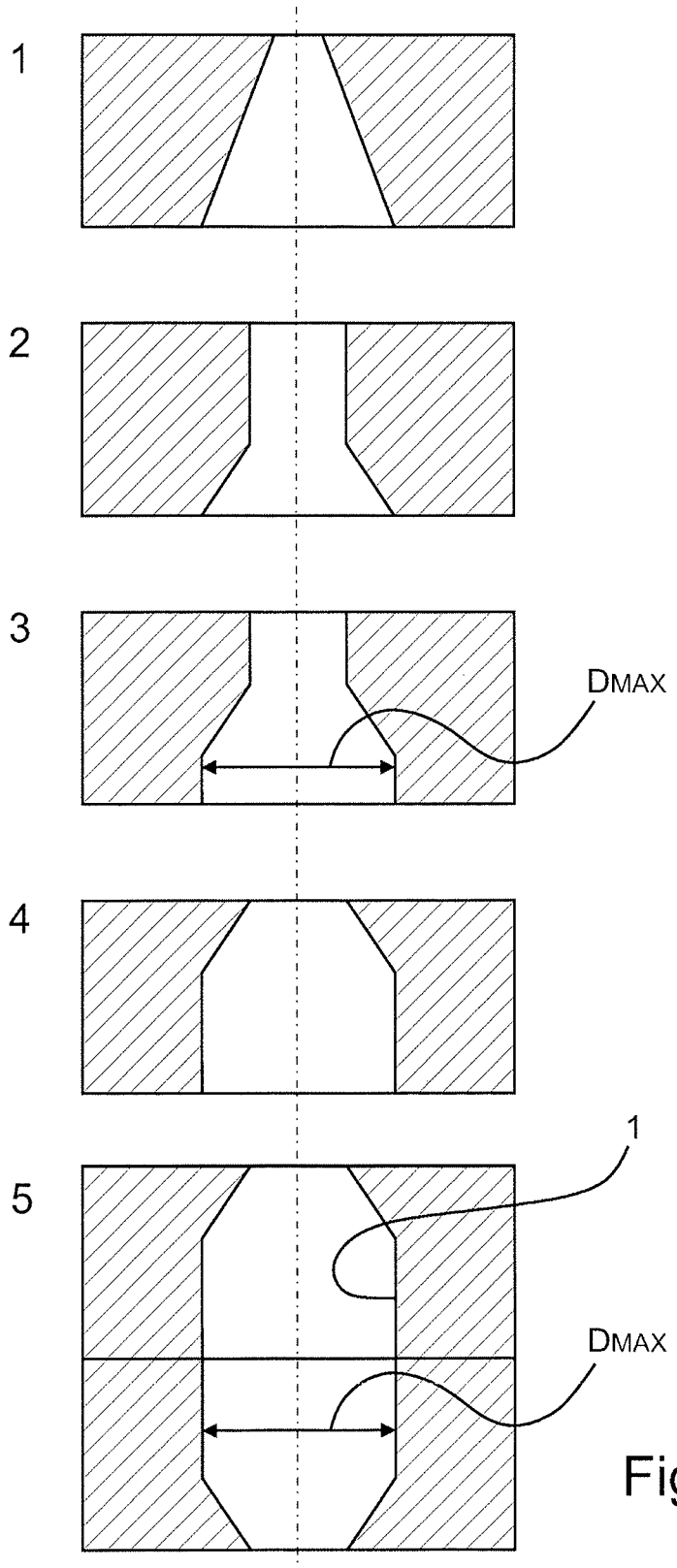

Exemplary different bore shapes or contour lines are illustrated in FIG. 1*b* that can be produced using the method according to the invention.

The largest diameter $D_{Max}$ is found on the lower end of the bore in the exemplary embodiments having numbers 1 to 4. The example having the number 5 illustrates that even rotationally symmetrical bores whose largest diameter is located neither on the upper nor the lower end can also be produced. The largest diameter $D_{MAX}$ in this example is located between the upper and the lower end of the bore.

In FIG. 2, the production of a non-cylindrical, rotationally symmetric bore is illustrated in four steps (a, b, c and d).

The contour line of the bore is provided with reference character 1. In a non-cylindrical bore, target diameter $D_{SOLL}$ is a function of the longitudinal axis Y ($D_{SOLL}$=f(y)).

In the exemplary embodiment represented in FIG. 2, the bore has a cylindrical section on its upper end and an additional cylindrical section c on its lower end. The diameter in the region of the upper section b is smaller than diameter $D_{Soll}$ in lower section c.

The starting point of the method according to the invention is a cylinder block in which the bore has been premachined so that it has a cylindrical shape with diameter $D_{Ist,0}$. In this state, the machining according to the method of the invention begins by a honing tool having a honing bar (not shown) being inserted into the bore with diameter $D_{Ist,0}$. The bore is honed along the entire length of the bore. The reversal points of the honing tool or its honing bars are designated with $OP_1$ and $UP_1$ (see FIG. 2*a*).

By means of the honing process, diameter $D_{IST}$ of the bore is enlarged uniformly over its entire length starting from $D_{Ist,0}$ until the still-cylindrical bore has the diameter $D_{Ist,1}$.

Figures 2A, 2B:
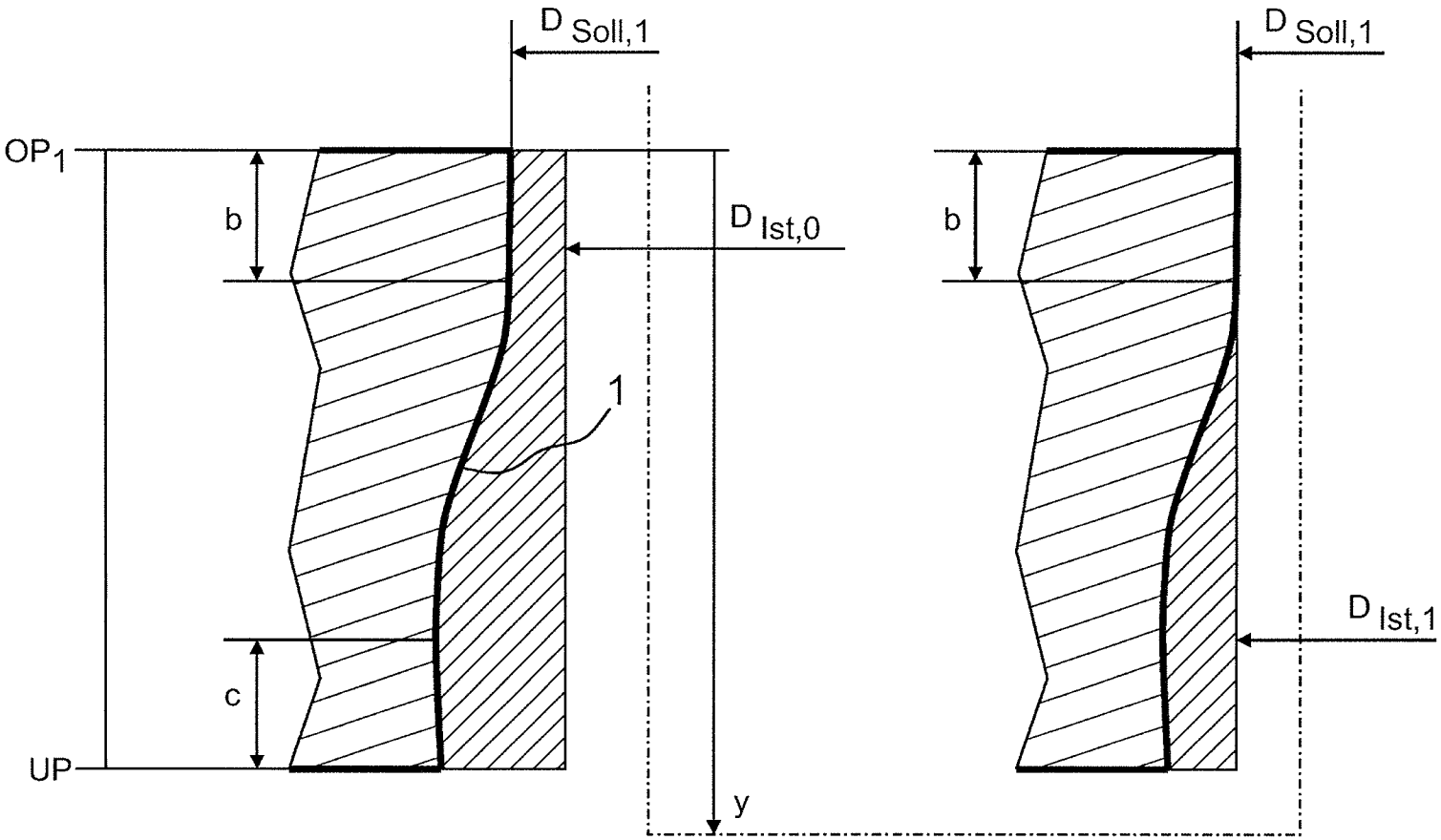
FIG. 2: an exemplary embodiment of the method according to the invention.

It is evident from FIG. 2*b* that diameter $D_{Ist,1}$ of the bore in this state is equal to target diameter $D_{Soll,\ 1}$ in region b. The actual diameter of the bore is preferably determined according to the invention during the honing process and compared to target diameter $D_{Soll}$ in region b of the bore.

As soon as the diameter of bore $D_{Ist}$ is equal to target diameter $D_{Soll,\ 1}$ in region b, the method according to the invention provides that the stroke of the honing tool is reduced in such a manner that region b is not machined further.

This is achieved in this dislocated by upper reversal point OP (see FIG. 2*c*) being displaced in the direction of lower reversal point UP so that "new" upper reversal point $OP_2$ is located below region b. Below region b, target diameter $D_{Soll,\ 2}$ is larger than target diameter $D_{Soll,\ 1}$ in region b. Therefore, the region below region b must be further honed in order to achieve the desired bottle-shaped or bottle-neck shaped contour line 1.

During the honing process with reversal points OP2 and UP (see FIG. 2*c*), a new target value $D_{Soll,\ 2}$ applies for the part of the bore that is yet to be machined. The actual value of the region of the bore being machined during the machining is compared to target value $D_{Soll,\ 2}$. As soon as actual value $D_{Ist}$ is equal to target value $D_{Soll\ 2}$, the stroke is further reduced or the machining is ended if the desired contour line 1 has been produced.

Figures 2C, 2D:
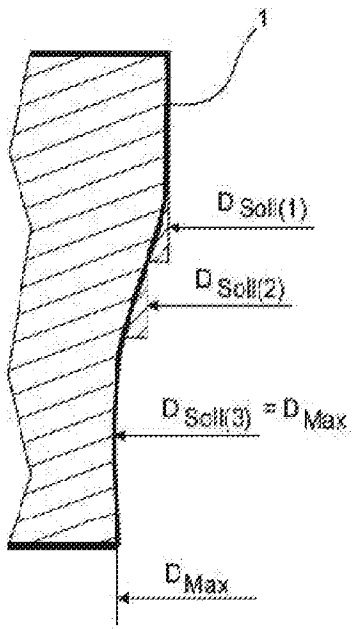

As soon as actual diameter $D_{Ist}$ of the bore in the region between $OP_2$ and UP is equal to the target value at the upper reversal point OP2, the stroke is further reduced (not shown in FIG. 2*c*).

FIG. 2*d* shows three different target diameters, $D_{Soll\ 1}$, $D_{Soll,\ 2}$ and $D_{Soll\ 3}$, from which desired contour line 1 is assembled. It is clear from this illustration that contour line 1 is approximated by a plurality of cylindrical sections having diameters $D_1$, $D_2$ *and* $D_3$. The illustrations in FIGS. 2*a* to *d* are greatly exaggerated.

The differences between diameters $D_{Soll,\ 1}$, $D_{Soll,\ 2}$ and $D_{Soll,\ 3}$ and the corresponding actual diameters $D_1$, $D_2$ and $D_3$ are only a few thousandths of a millimeter. Because of the permanent measuring, a permanent stroke displacement also takes place with the smallest variations in travel, so that a continuous, stepless shape is produced. The respective variation in travel is only limited by the resolution of the position sensor for the stroke movement that is substantially smaller than the local slope of the desired shape. During the subsequent smooth-honing that takes place along the entire length of the bore, the previously prepared shape is machined to the desired final roughness profile. The "steps" in FIGS. 2*c* and 2*d* are shown greatly exaggerated and only serve for better understanding of the control. Because of the pneumatic permanent measuring, a permanent stroke dislocation takes place, whereby there are continuous local shape changes.

Figure 3:
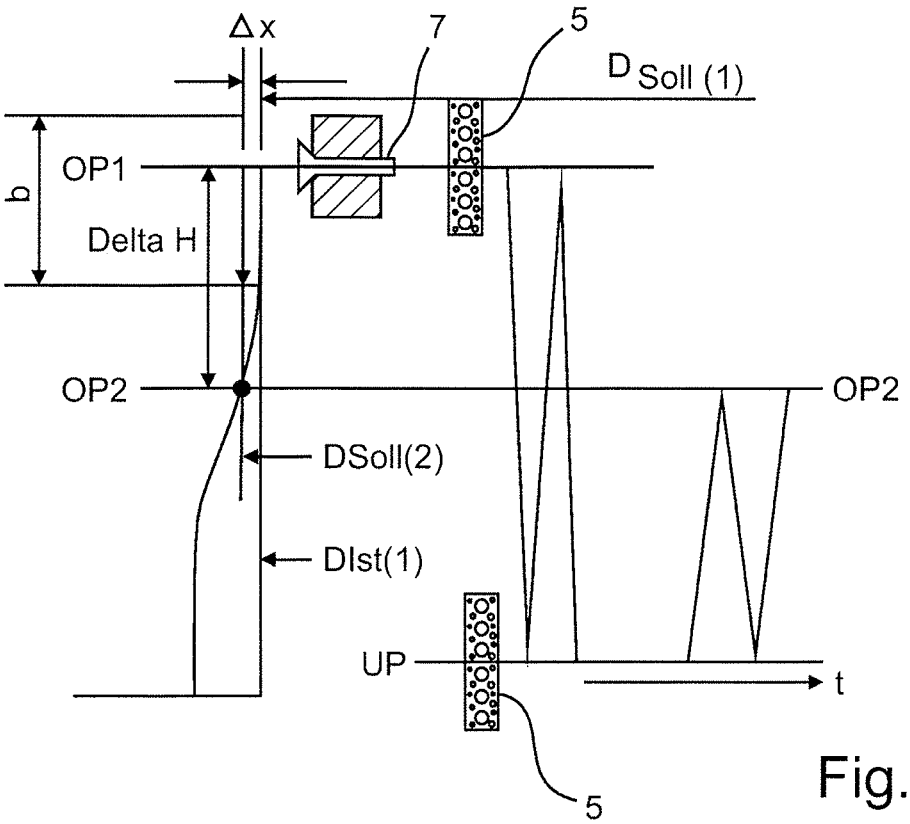
FIGS. 3 and 4: two alternatives for the stroke reduction.

A first variant of the reduction of the stroke according to this invention is illustrated using FIG. 3. This variant is designated as "default constant DeltaH for the determination of DeltaX".

The honing tool or the honing bars 5 belonging to the honing tool are shown very schematically once at the upper reversal point OP and once at the lower reversal point UP. The stroke of the honing bars corresponds to the spacing of OP1 and UP if the bore is honed along its entire length.

Figure 4:
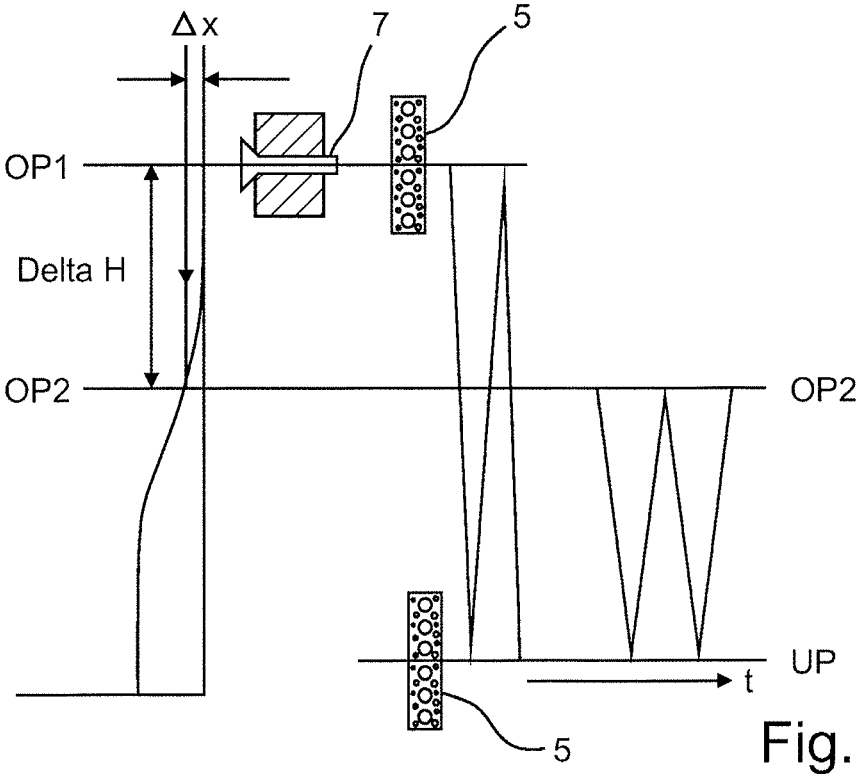
Figure 5A:
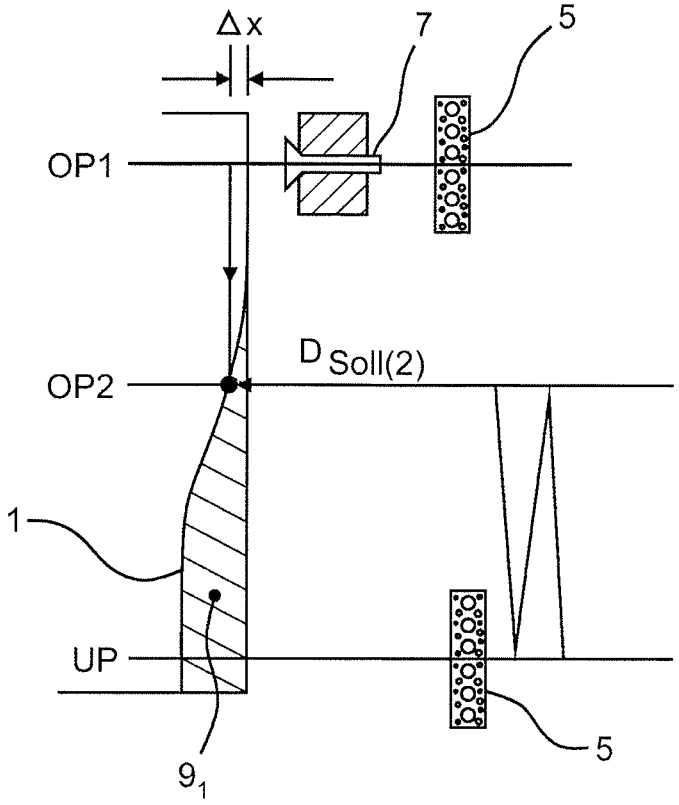
FIG. 5: an illustration similar to that in FIG. 2.
Figure 5B:
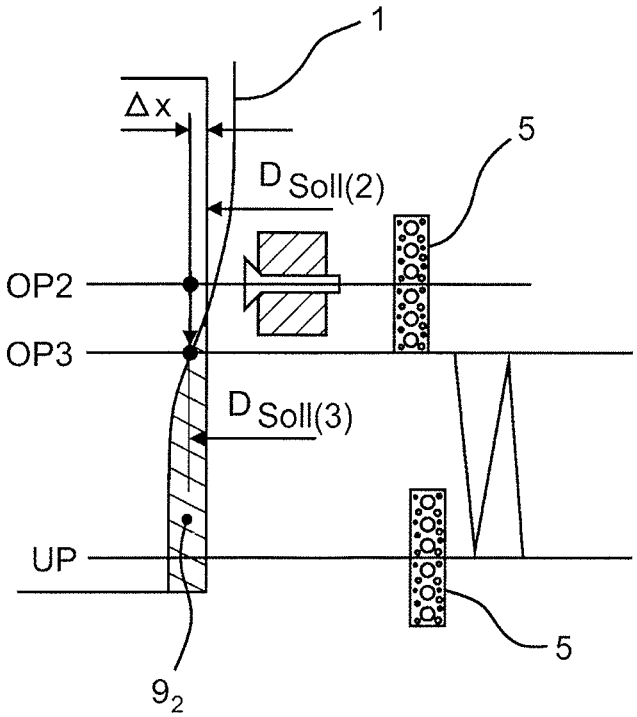
Figure 5C:
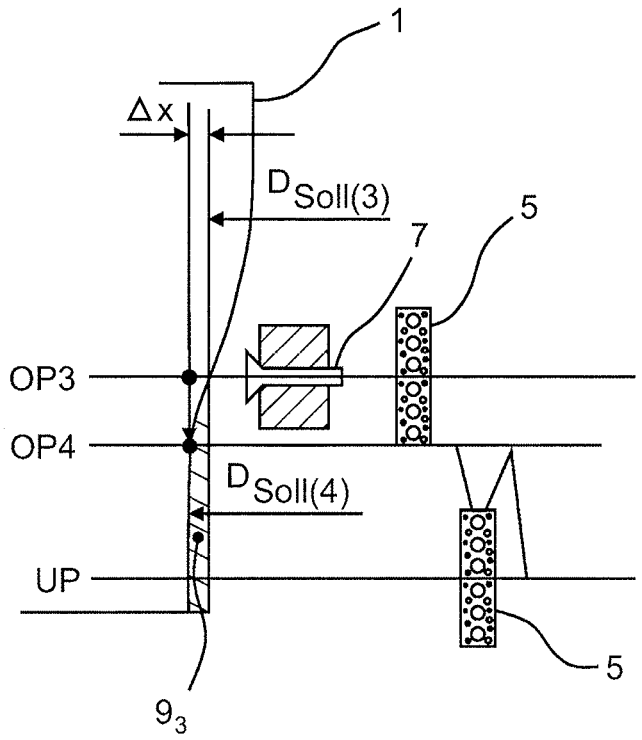
Figure 5D:
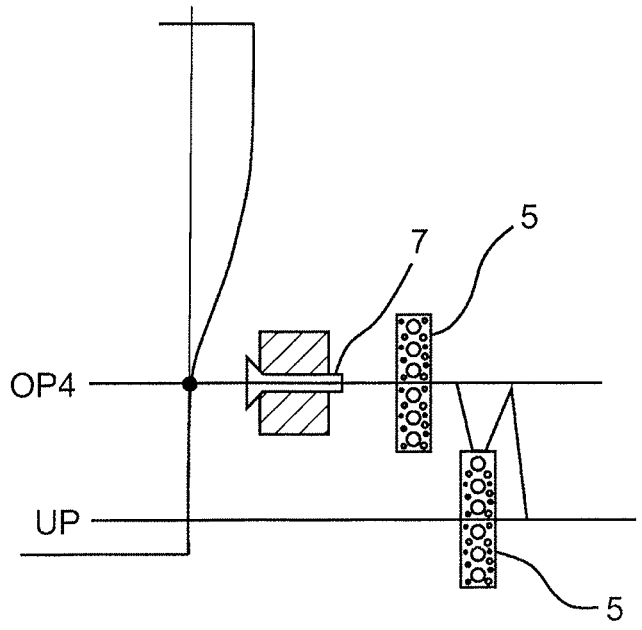

An air-measurement nozzle that belongs to the honing tool is provided with the reference character 7 in FIGS. 3 and 4. Air-measurement nozzles 7 are only shown at the upper reversal point of the honing tool. Because the air-measurement nozzles are integrated into the honing tool, they complete the same movements as honing bars 5. If actual diameter $D_{IST}$ of the bore has reached diameter $D_{SOLL,\ 1}$, stroke Hub H1 (=OP1−UP) is reduced by an amount DeltaH.

The amount of DeltaH can be specified by the operator of the honing machine as a parameter in the control system.

Because the bore in region b, where reversal point OP1 is located, already has desired target diameter $D_{Soll\ (1)}$, upper reversal point OP2 is dislocated downward in the direction of lower reversal point UP. New reversal point OP2 is obtained by the displacement of previous upper reversal point OP1 by the amount DeltaH in the direction of lower reversal point UP.

A second target diameter $D_{Soll,2}$ is associated with a new second reversal point OP2. Second target diameter $D_{Soll,2}$ is equal to the target diameter of the bore at reversal point OP2.

New diameter $D_{Soll,\ 2}$ at reversal point OP2 can also be determined based on diameter $D_{Soll\ (1)}$ using the formula $D_{Soll,2}=D_{Soll,\ 1}$+DeltaX.

The amount of DeltaX is not constant, but depends upon the slope of the contour line at upper reversal point OP1 and new upper reversal point OP2. Because the contour line of the bore is stored in the machine controls—for example, as a polynomial or a table of values—the corresponding target diameter at the reversal point can be determined for each reversal point OP, UP.

The strokes of the honing tool over the time t are plotted in the right-hand part of FIG. 3. It is clear that a larger stroke $H_1$=OP1 and UP takes place in the first machining step. In the second step, stroke $H_2$ is significantly smaller. (H=OP2−UP).

The variant "default constant DeltaX for the determination of DeltaH" is represented in FIG. 4 and explained below. In this variant, based on a diameter $D_{Ist}$ or $D_{Soll,1}$, a constant DeltaX is added to target diameter $D_{Soll,1}$. New upper reversal point OP2 is determined from the cutting point between contour line 1 and new target diameter $D_{Soll,\ 2}=D_{Soll,\ 1}$+DeltaX. In this variant, the stroke between OP1 and OP2 or between $OP_n$ and $OP_{n+1}$ is not reduced by a constant amount. The reduction of the stroke is greater or lesser depending upon how greatly the contour line in the region between current upper reversal point $OP_n$ and new upper reversal point $OP_{n+1}$ changes.

It is clear that the reduction of the stroke can be implemented not only in the region of the upper reversal OP point, but also in the region of lower reversal point UP.

For reasons of clarity, such an exemplary embodiment is not shown. Reference is made to FIG. 1*b* no. 5. A contour line is illustrated there that requires that upper reversal point OP as well as lower reversal point UP be displaced in order to achieve the desired target shape.

FIG. 5*a* to *d* and FIGS. 2*a* to *d* have many similarities. The principle is explained in reference to FIGS. 2*a* to *d*; in FIGS. 5*a* to *d*, the algorithm according to the invention is highlighted along with the corresponding illustrations.

The crosshatched surfaces $\mathbf{9}_1$, $\mathbf{9}_2$ and $\mathbf{9}_3$ illustrate where material must still be removed in order to achieve desired contour line 1.

All figures are schematic illustrations and are not to scale.

In the method variants described so far, it was assumed that the wall of the (cylinder) bore to be machined is so thick that the forces acting in the radial direction on the wall during the honing process by the honing bars effect no or only small deformations on the wall. The radial force (contact pressure force) with which the honing bars are pressed against the cylinder bore are caused by the feeding device or the control of the honing machine of the.

This principle functions for quasi-fixed workpiece structures or workpieces whose wall thickness is constant. These conditions are not always present in practice for modern cylinder crankcases, so that elastic deformations due to machining forces arise because of locally varying wall thicknesses and/or high feeding forces during the machining and the removed material shifts away in the radial direction (radial widening). Because the widening is elastic, the wall "springs" back as soon as the honing process is completed. In this manner, the achieved actual shape in the tensioned state deviates strongly from the target shape. This circumstance is illustrated in FIGS. 6*a* and *b*. Only the "half" cylinder bore is shown in FIG. 6*a*. Its central axis is shown as a dot and dash line 30. The length of the cylinder bore in this example comprises a thick-walled section 32 and a thin-walled section 34. The desired target shape is indicated with 36.

Figure 6B:
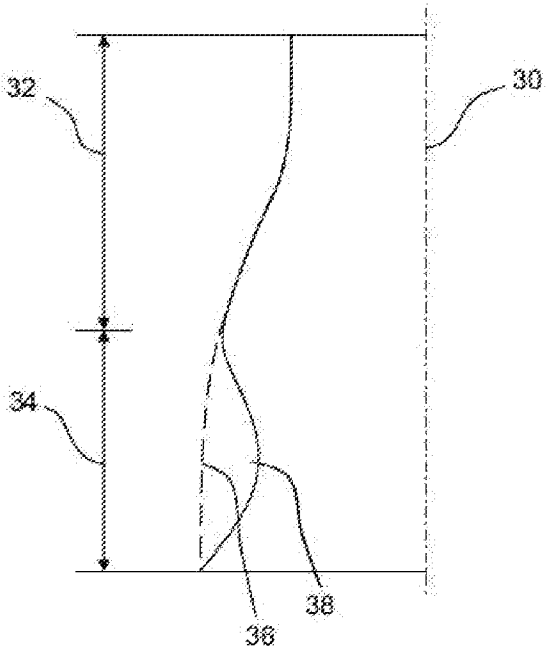
FIGS. 6*a* to *d*: an additional embodiment of the method according to the invention.
Figure 6A:
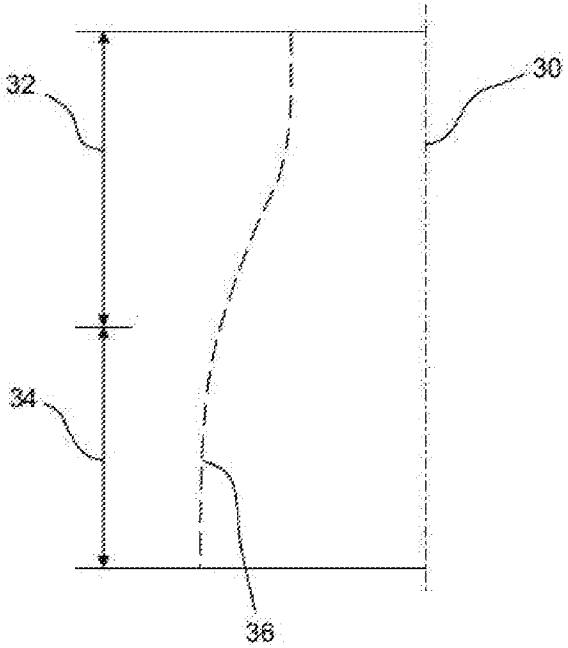

If the bore is now widened radially in thin-walled section 34 during the honing process and the desired target shape is produced corresponding to line 36 according to the method of the invention, the bore then springs radially back after the end of the honing process and results in an actual shape according to line 38 in FIG. 6*b*.

It is clear from a comparison of lines 36 and 38 that the actual shape and the target shape in thin-walled section 34 vary significantly from each other.

A solution according to the invention for this problem is that the target shape 36 becomes, at least locally, a corrected target shape.

The corrected target shape is the shape that the cylinder bore must assume during the honing process in order for it to have the desired target shape 36 after the end of the honing process and without radial widening.

The corrected target shape is obtained by the radial widening being added to target shape 36 (particularly in the region of thin-walled section 34). The corrected target shape in FIG. 6*c* has the reference character 42.

Figure 6D:
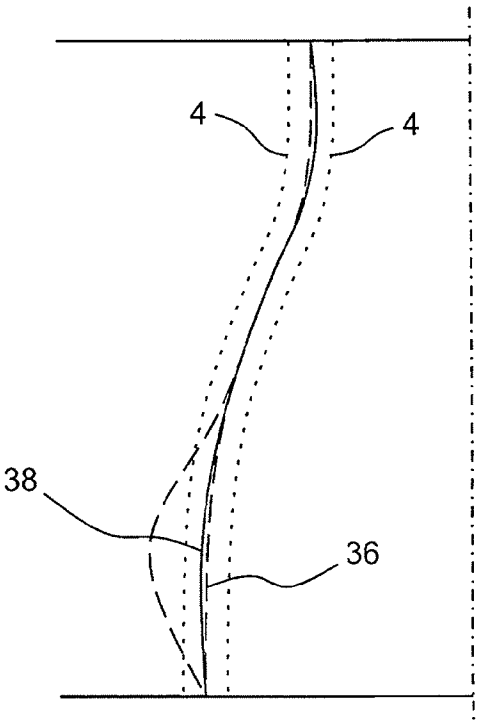
Figure 6C:
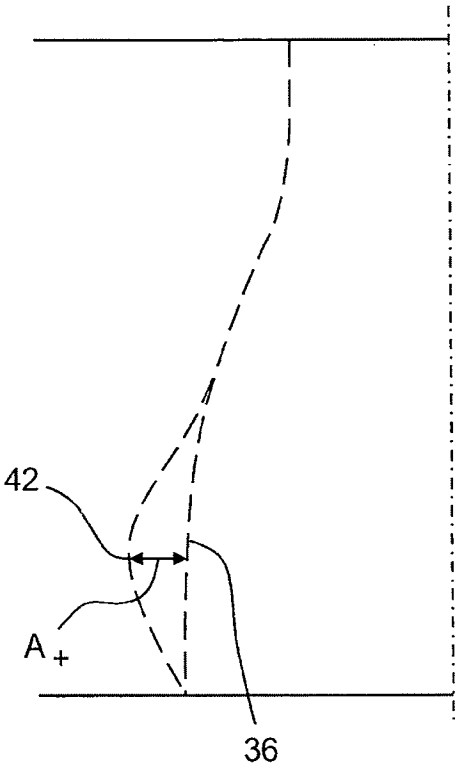

If the cylinder bore is now brought into corrected target shape 42 via the method according to the invention, the deviations between actual shape 38 and target shape 36 of the cylinder bore after the end of the honing process are minimal. This circumstance is illustrated in FIG. 6*d*.

In other words: Corrected target shape 42 offsets these local different deformations by additional local material removal. In this manner, it is possible to keep the diameter of the non-cylindric rotationally symmetric cylinder bore within a very narrow tolerance zone between lines 44 along the entire length of the cylinder bore.

Corrected target shape 42 can be determined empirically or by calculation. In the case of an empirical determination, it is possible to iteratively change from the target shape to the corrected target shape based on the particular results achieved by correcting the target shape in small steps (for example in the range of one more micrometers) at a plurality of support points until the actual shape (see 38 in FIG. 6*c*) in the tensioned state corresponds to the target shape (see 36 in FIG. 6*c*).

In the case of a calculated determination, the radial widening (Ar) of the cylinder bore in thin-walled region 34 can be at least roughly determined based on the force with which the honing bars are pressed against the cylinder wall and this widening can be added to target shape 36. Starting from the target shape, the respective results achieved can be iteratively changed to the corrected target shape if the target shape is corrected in small steps at a plurality of support points (for example in the region of one or a plurality of micrometers) until the actual shape (see 38 in FIG. 6*c*) in the tensioned state corresponds to the target shape (see 36 in FIG. 6*c*).

What is claimed is:

1. A method for producing a rotationally symmetric, non-cylindrical bore using a honing tool having honing bars, comprising the following steps:

a. honing of the bore with a stroke of the honing tool, wherein the stroke (H) is limited by an upper reversal point (OP) and a lower reversal point (UP), b. continuously detecting actual values of an actual diameter (DIST) of the bore, wherein the bore includes a specified target diameter that varies over a length of the bore to be machined during the honing process in a region between the upper and lower reversal points;

c. continuously comparing the actual diameter of the bore to a specified target diameter for at least one of the upper or lower reversal points;

d. continuously limiting the stroke to regions of the bore in which the actual diameter is smaller than the target diameter;

e. reducing the stroke of the honing tool step-by-step based on detected actual values of the diameter of the bore, so that only the regions of the bore are machined by the honing tool in which the actual diameter of the bore is still smaller than the target diameter;

f. wherein, reducing the stroke to a reduced stroke is done when the actual diameter is equal to the target diameter for at least one of the upper and lower reversal points, and wherein the stroke is reduced such that the honing bars of the honing tool having the reduced stroke no longer machine the upper or lower reversal point at which the actual diameter is equal to the target diameter;

g. determining a new local target diameter by addition of a diameter increment to the actual diameter at one of the upper or lower reversal points, such that a new reversal point is located where the specified target diameter of the bore is equal to the new local target diameter; and h. further reducing the stroke of the honing tool when the actual diameter at the new reversal point of the honing tool is equal to the new local target diameter by addition of the diameter increment to determine a next new reversal point.

2. The method according to claim 1, wherein the reduced stroke is equal to the stroke minus a specified amount.

3. The method according to claim 1, characterized in that the bore is initially honed along its entire length (L).

4. The method according to claim 1, comprising the step of correcting the target diameter of the non-cylindrical bore by compensating for a radial widening of the cylinder bore during the honing process.

5. The method according to claim 4, wherein the corrected target diameter corresponds to a target diameter which has been elastically widened during the honing process.

6. The method according to claim 1, comprising the step of specifying the target diameter of the non-cylindrical bore as a function of a longitudinal axis of the bore.

7. The method according to claim 1 comprising the step of specifying the target diameter of the non-cylindrical bore in a table of values.

8. The method according to claim 7, comprising the step of determining a target shape of the non-cylindrical bore by interpolating between reference points of the table of values.

9. The method according to claim 1, comprising the step of increasing a speed of the honing spindle as the stroke decreases.

10. The method according to claim 1, comprising the step of increasing a honing bar contact pressure as the stroke decreases.

* * * * *